US008007233B2

(12) United States Patent
Yang et al.

(10) Patent No.: US 8,007,233 B2
(45) Date of Patent: Aug. 30, 2011

(54) FAN FRAME

(75) Inventors: Zhi-Cheng Yang, Shenzhen (CN); Li Bei, Shenzhen (CN); Ying-Min Huang, Taipei Hsien (TW); Ying-Sen Chen, Taipei Hsien (TW); Mei-Fang Cao, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 927 days.

(21) Appl. No.: 11/957,341

(22) Filed: Dec. 14, 2007

(65) Prior Publication Data

US 2009/0068009 A1 Mar. 12, 2009

(30) Foreign Application Priority Data

Sep. 7, 2007 (CN) ..... 2007 1 0077017

(51) Int. Cl.
*F01D 25/12* (2006.01)

(52) U.S. Cl. ..... 415/213.1; 415/214.1

(58) Field of Classification Search ..... 415/213.1, 415/214.1; 417/423.14; 310/71
See application file for complete search history.

(56) References Cited

U.S. PATENT DOCUMENTS 6,174,145 B1 * 1/2001 Taniguchi ..... 417/423.14
6,388,196 B1 * 5/2002 Liu et al. ..... 174/135

FOREIGN PATENT DOCUMENTS

| | | | |
|---|---|---|---|
| CN | 200520037224.6 | | 4/2007 |
| JP | 11-89168 | A | 3/1999 |
| JP | 2003-269395 | A | 9/2003 |
| TW | 580073 | | 3/2004 |
| TW | 588496 | | 5/2004 |
| TW | M291192 | | 5/2006 |

* cited by examiner

*Primary Examiner* — Edward Look
*Assistant Examiner* — Dwayne J White
(74) *Attorney, Agent, or Firm* — Altis Law Group, Inc.

(57) ABSTRACT

A fan frame includes a housing (10), a supporting base (20) and a plurality of ribs (30) connecting the housing with the supporting base. One of the ribs includes a bottom wall (33), and first and second lateral walls (31, 32) extending from two opposite sides of the bottom wall, respectively. A receiving groove (35) is defined between the bottom wall and the lateral walls. A securing tab (40) extends from an outer end of the first lateral wall towards the second lateral wall. A securing finger (42) extends aslant from a free end of the tab towards the second lateral wall. A slot (50) is defined between the finger and the second lateral wall with a width thereof gradually decreased inwardly. The tab, the finger, the bottom wall and the first lateral wall cooperatively define a gap (45) therebetween for extension of power wires (60) of the fan.

12 Claims, 5 Drawing Sheets

FAN FRAME

BACKGROUND OF THE INVENTION

1. Field of the Invention

The present invention relates generally to a fan frame, and more particularly to a fan frame of an electric fan which can secure power wires of the fan firmly and easily.

2. Description of Related Art

With the continuing development of electronic technology, electronic packages such as CPUs (central processing units) are generating more and more heat which requires immediate dissipation. Electric cooling fans are commonly used for cooling the CPUs.

The CPU is typically mounted on a circuit substrate (for example, a printed circuit board) of an electronic equipment such as a computer, and a power supply socket through which power is supplied to the fan is also provided on the circuit substrate. The fan is provided with power wires, one end of the power wires being soldered to a drive circuit mounted within the fan, the other end of the power wires being provided with a power supply terminal for being connected to the power supply socket on the circuit substrate to get power supply. In order to secure the power wires, adhesive or a tying tape is used for sticking or tying the power wires on the fan frame. However, such means are time-consuming in operation, causing a high cost and low manufacture efficiency.

What is needed, therefore, is an improved fan frame which can overcome the above problems.

SUMMARY OF THE INVENTION

In accordance with an embodiment of the present invention, a fan frame for an electric fan includes a housing, a supporting base arranged in one side of the housing and a plurality of ribs connecting the housing with the supporting base. One of the ribs includes a bottom wall, and first and second lateral walls extending upwardly from two opposite lateral sides of the bottom wall, respectively. A receiving groove is thus defined between the bottom wall and the lateral walls. A securing tab extends from an outer end of the first lateral wall towards an outer end of the second lateral wall. A securing finger extends aslant and inwardly from an end of the securing tab towards the second lateral wall. A slot is defined between the securing finger and the second lateral wall with a width of the slot gradually decreased inwardly. The securing tab, the securing finger, the bottom wall and the first lateral wall cooperatively define a gap therebetween adapted for extension of power wires of the fan.

Other advantages and novel features of the present fan frame will become more apparent from the following detailed description when taken in conjunction with the accompanying drawings, in which:

BRIEF DESCRIPTION OF THE DRAWINGS

Many aspects of the present fan frame can be better understood with reference to the following drawings. The components in the drawings are not necessarily drawn to scale, the emphasis instead being placed upon clearly illustrating the principles of the present fan frame. Moreover, in the drawings, like reference numerals designate corresponding parts throughout the several views.

DETAILED DESCRIPTION OF THE INVENTION

Figure 1:
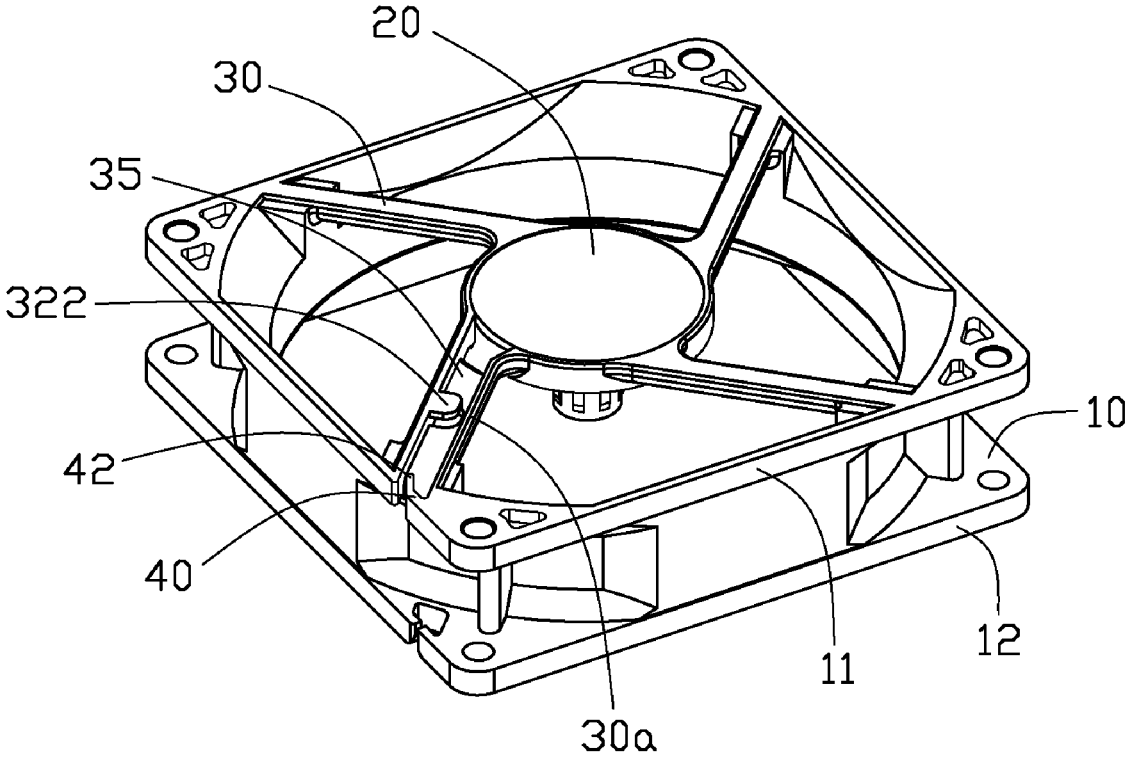
FIG. 1 is an isometric view of a fan frame, in accordance with a preferred embodiment of the present invention, wherein the fan frame is shown in a reversed position.

Referring to FIG. 1, a fan frame of an electric fan in accordance with a preferred embodiment of the invention includes a housing 10, a supporting base 20 arranged at a top side of the housing 10 and four ribs 30 connecting the housing 10 and the supporting base 20.

The housing 10 is approximately square-shaped with a cylindrical receiving space defined therein for receiving a rotor (not shown) and a stator (not shown) of the fan. A squared top flange 11 and a squared bottom flange 12 are formed at the top side and a bottom side of the housing 10, respectively. The supporting base 20 is approximately round-shaped, and arranged at the top side of the housing 10, corresponding to a center position of the top flange 11. The four ribs 30 extend outwardly from the supporting base 20 to the housing 10 of the fan frame, with outer ends of the ribs 30 connected with four corners of the top flange 11 of the housing 10. The ribs 30 are evenly spaced from each other along a circumference of the supporting base 20. The rotor and the stator of the fan are received in the housing 10 and mounted to the supporting base 20.

Figure 2:
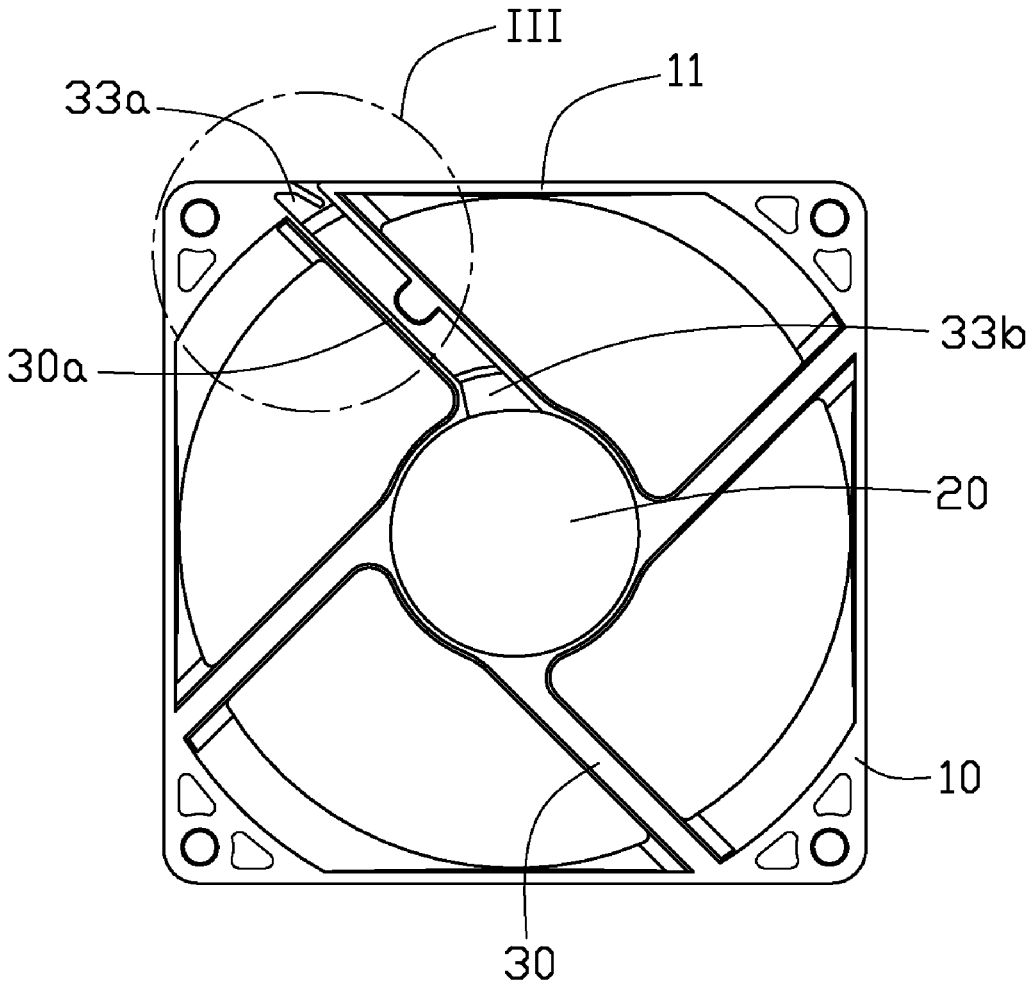
FIG. 2 is a top plan view of the fan frame of FIG. 1.
Figure 3:
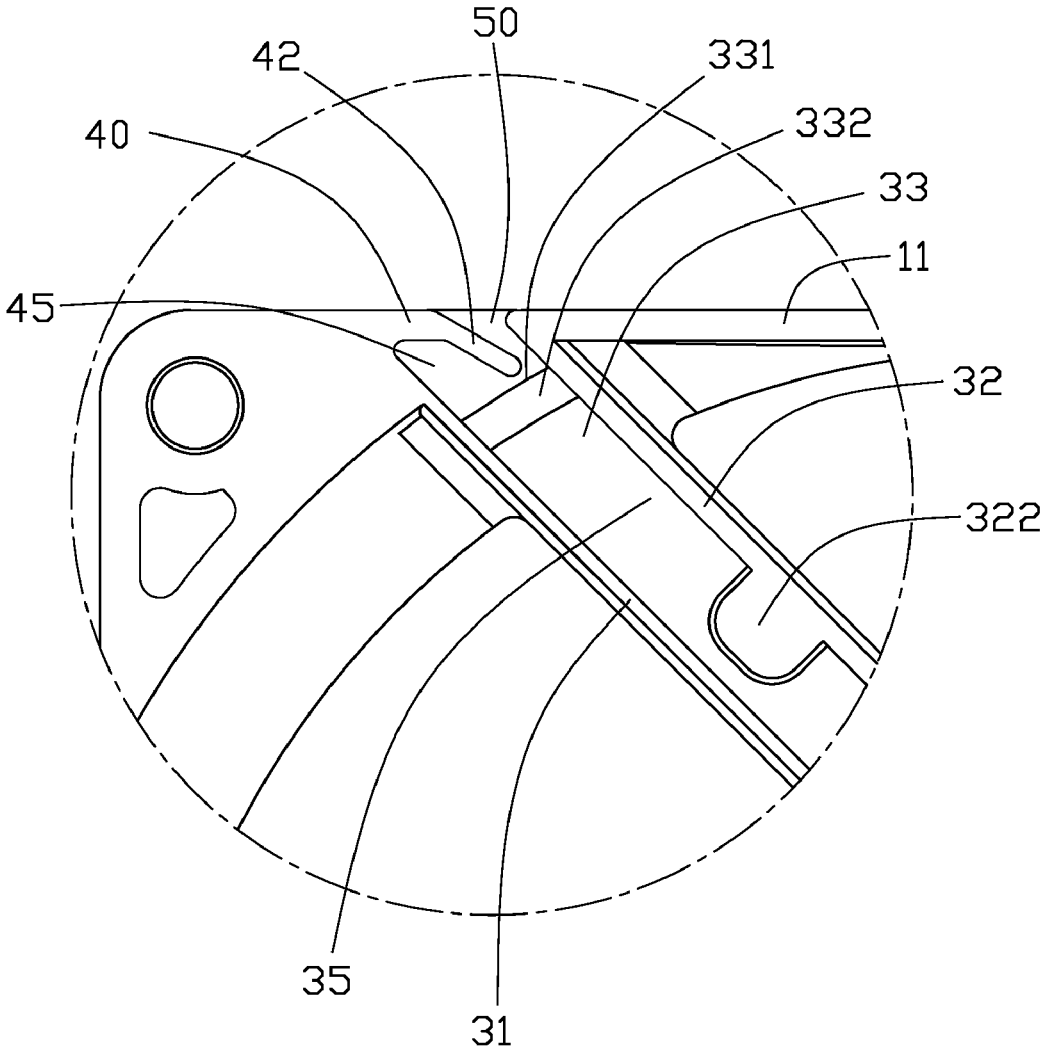
FIG. 3 is an enlarged view of a circle portion III of the fan frame of FIG. 2.
Figure 4:
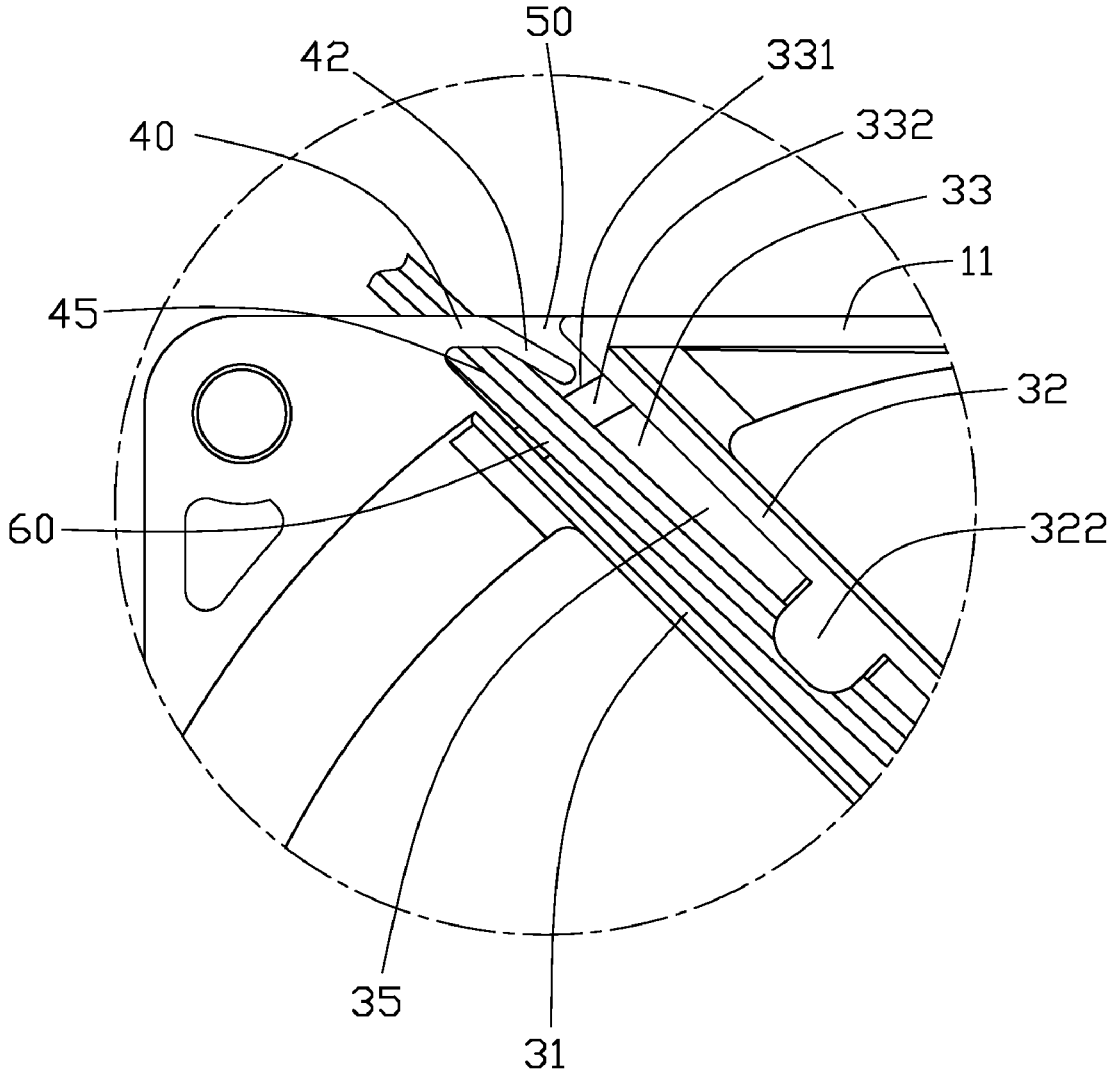
FIG. 4 is similar to FIG. 3, showing power wires of the fan being fixed in the fan frame.

Referring also to FIGS. 2-4, a receiving groove 35 for receiving power wires 60 of the fan is defined in one of the ribs 30, i.e., rib 30*a*. The rib 30*a* includes a bottom wall 33 and two lateral walls 31, 32 extending upwardly and perpendicularly from two lateral sides of the bottom wall 33. A length of the bottom wall 33 is shorter than that of the two lateral walls 31, 32, and two through holes 33*a*, 33*b* for the power wires 60 to extend therethrough are defined at two ends of the rib 30*a*. The bottom wall 33 has a chamfered surface 332 formed near the through hole 33*a*.

A mounting tab 322 extends from a top end of the lateral wall 32 towards a top end of the lateral wall 31 and is located at an approximately central position of the rib 30*a*. The mounting tab 322 substantially has a square-shaped profile and is arranged in parallel to the bottom wall 33. A vertical distance is defined between the mounting tab 322 and the bottom wall 33 of the rib 30*a*, and a horizontal distance is defined between the mounting tab 322 and the top end of the lateral wall 31 for allowing the power wires 60 to enter into the receiving groove 35.

A securing tab 40 extends horizontally from an outer end of the lateral wall 31 towards an outer end of the lateral wall 32. A securing finger 42 extends slantwise and inwardly from an end of the securing tab 40 towards the lateral wall 32. A slot 50 is defined between the securing finger 42 and the lateral wall 32 with a width of the slot 50 gradually decreased inwardly. In other words, the width of the slot 50 is gradually decreased as the securing finger 42 extends from the securing tab 40 towards the lateral wall 32. A minimum width of the slot 50 is defined at a position between an outmost free end of the securing finger 42 and the lateral wall 32, which could be identical to or a little smaller than a diameter of a single power wire 60. This can facilitate the insertion of the power wires 60 into the receiving groove 35 and prevent the power wires 60 from being damaged by scratching in the slot 50 and from being dropped out of the slot 50. In the present embodiment, the minimum width of the slot 50 is identical to the diameter of a single power wire 60. A gap 45 is defined between the securing tab 40, the securing finger 42 and an outmost edge 331 of the bottom wall 33. The gap 45 is communicated with the receiving groove 35, whereby the power wires 60 received in the receiving groove 35 can extend out of the fan frame through the gap 45. A distance is defined between the outmost free end of the securing finger 42 and the chamfered surface 332 of the bottom wall 33, as viewed from FIG. 3. In other words, the outmost free end of the securing finger 42 is spaced apart from the chamfered surface 332 of the bottom wall 33 for facilitating the insertion of the power wires 60 from the slot 50 into the gap 45.

Figure 5:
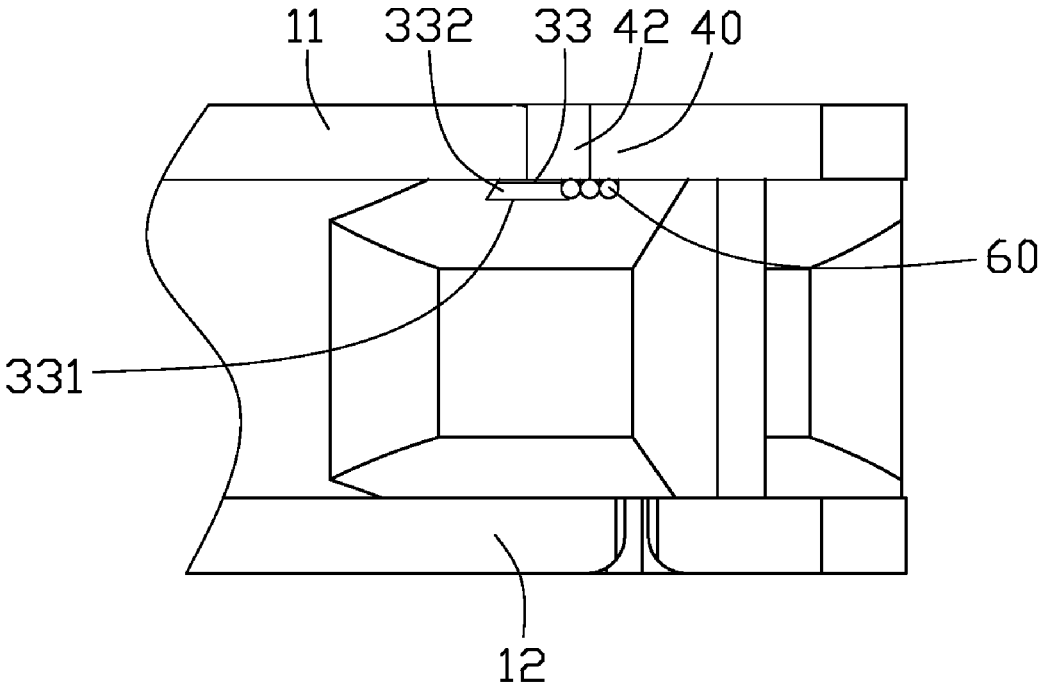
FIG. 5 is a side elevational view of FIG. 4.

Referring to FIG. 5, the bottom wall 33 is located below the securing tab 40 and the securing finger 42. The power wires 60 can extend from the receiving groove 35, through the gap 45 and finally out of the fan frame more conveniently and smoothly.

When assembled, the power wires 60 extend outwardly from the supporting base 20 along the receiving groove 35. When reaching the mounting tab 322 of the lateral wall 32, the power wires 60 are pushed to enter into the receiving groove 35 through the horizontal distance between the mounting tab 322 and the lateral wall 31. When reaching the slot 50, the power wires 60 are pushed to slide over the securing finger 42 and then moved laterally to slide over the chamfered surface 332 of the bottom wall 33 to finally enter into the gap 45. A free end of the power wires 60 extends out of the fan frame via the gap 45 for being electrically connected to a power source (not shown). In this way, the power wires 60 are cooperatively secured in the receiving groove 35 and the gap 45 firmly. The mounting tab 322 prevents the power wires 60 secured in the receiving groove 35 from escaping away from the receiving groove 35. The securing tab 40 and the securing finger 42 cooperatively secure the power wires 60 in the gap 45 and prevent the power wires 60 from escaping away from the gap 45.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A fan frame for an electric fan, comprising:
a housing;
a supporting base arranged at one side of the housing; and
a plurality of ribs connecting the housing with the supporting base, one of the ribs comprising a bottom wall, and first and second lateral walls extending upwardly from two opposite lateral sides of the bottom wall, respectively, a receiving groove being defined between the bottom wall and the first and second lateral walls, a securing tab extending from an outer end of the first lateral wall towards an outer end of the second lateral wall, an elongated securing finger extending aslant and inwardly from an end of the securing tab towards the second lateral wall, a slot being defined between the securing finger and the second lateral wall with a width of the slot gradually decreased inwardly along a length of the securing finger from a portion of the securing tab from which the securing finger extends to an outmost free end of the securing finger, the securing tab, the securing finger, the bottom wall and the first lateral wall cooperatively defining a gap therebetween adapted for extension of power wires of the fan.

2. The fan frame of claim 1, wherein a minimum width of the slot is the same as a diameter of a single power wire.

3. The fan frame of claim 1, wherein a distance is defined between an outer end of the bottom wall and a free end of the securing finger for allowing the power wires to enter the gap from the slot.

4. The fan frame of claim 3, wherein a chamfered surface is formed at the outer end of the bottom wall for guiding the power wires into the gap from the slot.

5. The fan frame of claim 1, wherein a mounting tab extends from a top end of the second lateral wall towards a top end of the first lateral wall, a distance being defined between the mounting tab and the top end of the first lateral wall for allowing the power wires to enter the receiving groove.

6. The fan frame of claim 5, wherein the mounting tab is formed substantially at a middle portion of the second lateral wall.

7. The fan frame of claim 1, wherein the bottom wall is located below the securing tab and the securing finger.

8. A cooling fan with power wires, comprising:
a housing comprising an outer flange;
a supporting base arranged at one side of the housing; and
a first rib and at least a second rib connecting the outer flange with the supporting base, the first rib defining a receiving groove adapted for retaining the power wires in the receiving groove, an elongated securing finger extending inwardly from the outer flange, a slot being defined between the securing finger and the first rib, the slot communicating with the receiving groove and having a width gradually decreased for guiding the powers wires into the receiving groove from the slot, the width of the slot being gradually decreased inwardly along a length of the securing finger from a portion of the outer flange from which the securing finger extends to an outmost free end of the securing finger.

9. The cooling fan of claim 8, wherein a gap is defined between the outer flange, the securing finger and the first rib, and the power wires in the receiving groove extend out of the housing through the gap.

10. The cooling fan of claim 9, wherein the first rib comprises a bottom wall and two lateral walls, a mounting tab extending from one of the two lateral walls towards the other one of the two lateral walls and configured for holding the power wires in the receiving groove.

11. The cooling fan of claim 10, wherein the bottom wall of the first rib has an outer chamfered surface confronting the gap and configured for guiding the power wires into the gap from the slot.

12. A fan frame for an electric fan, the fan frame comprising:
a housing;
a supporting base arranged at one side of the housing; and
a plurality of ribs connecting the housing with the supporting base, one of the ribs comprising a bottom wall, and first and second lateral walls extending upwardly from two opposite lateral sides of the bottom wall, respectively, a receiving groove being defined between the bottom wall and the first and second lateral walls, a securing tab extending from an outer end of the first lateral wall towards an outer end of the second lateral wall, a securing finger extending aslant and inwardly from an end of the securing tab towards the second lateral wall, a slot being defined between the securing finger and the second lateral wall with a width of the slot gradually decreased inwardly, the securing tab, the securing finger, the bottom wall and the first lateral wall cooperatively defining a gap therebetween adapted for extension of power wires of the fan;
wherein a distance is defined between an outer end of the bottom wall and a free end of the securing finger for allowing the power wires to enter the gap from the slot; and
wherein a chamfered surface is formed at the outer end of the bottom wall for guiding the power wires into the gap from the slot.

* * * * *